US010040669B2

(12) United States Patent
Zhang et al.

(10) Patent No.: US 10,040,669 B2
(45) Date of Patent: Aug. 7, 2018

(54) ASYNCHRONOUS DOOR KNIFE OF ELEVATOR INTEGRATED CAR DOOR LOCK

(71) Applicant: Otis Elevator Company, Farmington, CT (US)

(72) Inventors: Xiaobo Zhang, Hangzhou (CN); Qingxi Cai, Hangzhou (CN); Xiaoxiao Dong, Hangzhou (CN); Minchao Chen, Hangzhou (CN); Senyuan Qiao, Hangzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 162 days.

(21) Appl. No.: 15/024,067

(22) PCT Filed: Aug. 12, 2014

(86) PCT No.: PCT/US2014/050695
§ 371 (c)(1),
(2) Date: Mar. 23, 2016

(87) PCT Pub. No.: WO2015/041772
PCT Pub. Date: Mar. 26, 2015

(65) Prior Publication Data

US 2016/0236907 A1 Aug. 18, 2016

(30) Foreign Application Priority Data

Sep. 23, 2013 (CN) ..... 2013 1 0434808

(51) Int. Cl.
*B66B 13/12* (2006.01)

(52) U.S. Cl.
CPC ..... *B66B 13/12* (2013.01)

(58) Field of Classification Search
CPC ..... B66B 13/12
See application file for complete search history.

(56) References Cited

U.S. PATENT DOCUMENTS 5,950,766 A * 9/1999 Oberleitner ..... B66B 13/12 187/319
6,021,871 A * 2/2000 Grabner ..... B66B 13/12 187/335

(Continued)

FOREIGN PATENT DOCUMENTS

CN 102923554 A * 2/2013
CN 103287953 A 9/2013

(Continued)

OTHER PUBLICATIONS

English Machine Translation of CN 102923554 A.*

(Continued)

*Primary Examiner* — William E Dondero
*Assistant Examiner* — Diem M Tran
(74) *Attorney, Agent, or Firm* — Cantor Colburn LLP

(57) ABSTRACT

An asynchronous door knife comprises a track rack and a base plate; a dynamic blade and an unlocking blade which are connected on the front of the base plate in a swinging manner; a knife lifting ball which is arranged on the dynamic blade; a lock hook which is arranged on the back of the base plate and correspondingly buckled with a latch, wherein the unlocking blade is connected on the base plate through a lifting plate; the lifting plate is hinged on the base plate and comprises a first swing arm and a second swing arm; the first swing arm is hinged with the unlocking blade; the second swing arm is connected with an unlocking connecting rod; a lifting hole is additionally formed on the base plate; the middle of the lock hook is hinged with the unlocking connecting rod through the lifting hole.

10 Claims, 3 Drawing Sheets

(56) References Cited

U.S. PATENT DOCUMENTS

| | | | | | |
|---|---|---|---|---|---|
| 7,077,242 | B2 * | 7/2006 | Cocher | ..... | B66B 13/12<br>187/330 |
| 2006/0243535 | A1 * | 11/2006 | Kinoshita | ..... | B66B 13/12<br>187/319 |

FOREIGN PATENT DOCUMENTS

| | | | | | |
|---|---|---|---|---|---|
| EP | 1266860 | A1 * | 12/2002 | ..... | B66B 13/12 |
| EP | 1266860 | A1 | 12/2002 | | |
| EP | 2287104 | A1 * | 2/2011 | ..... | B66B 13/12 |
| JP | 2005170680 | A * | 6/2005 | ..... | B66B 13/12 |
| WO | WO-2005077808 | A2 * | 8/2005 | ..... | B66B 13/12 |
| WO | WO-2016130252 | A1 * | 8/2016 | | |

OTHER PUBLICATIONS

International Search report for application PCT/US2014/050695, dated Oct. 30, 2014, 4 pages.
Written Opinion for application PCT/US2014/050695, dated Oct. 30, 2014, 4 pages.

* cited by examiner

ASYNCHRONOUS DOOR KNIFE OF ELEVATOR INTEGRATED CAR DOOR LOCK

TECHNICAL FIELD

The invention relates to the technical field of elevators, and in particular relates to an asynchronous door knife of an elevator integrated car door lock, which is convenient to mount and debug and is better in safety performance.

TECHNICAL BACKGROUND

Popularization of elevators brings convenience to people's life, meanwhile, it also increases attention on safety of the elevator.

It specifies in the national standard that: horizontal distance between the inner surface of elevator well and the edge of car sill, car door frame or sliding door nearest to the door shall not be more than 0.15 m; in case that the car is equipped with a mechanically locked door and the lock is openable in an unlocking area of landing door only, except in special circumstances, running of the elevator shall be automatically determined by locking of the car door; locking of the car door shall be proved by an electrical safety device, and the distance mentioned above is not limited.

To meet requirements of the national standard, generally the prior art adds a protecting wall on the inner surface of the well or mounts an independent car door lock, so as to avoid danger if passengers open the car door to escape without understanding right escape means in advance in case of elevator accident.

However, it is relatively high in cost and long in elevator installation period to mount a protecting wall on the inner surface of the well; while, to mount an independent car door lock, it shall set unlocking blades on each floor and precisely turn the car door lock and the unlock blade on each floor when mounting the elevator, so that the car door lock can be accurately opened by the unlocking blade on each floor, but deviation is inevitable when the car move up and down in case that the floor is too high, which will enhance difficulty of mounting the unlocking blade on each floor and greatly improve failure rate of the car door lock.

According to the prior art, for door knives and car door locks of most elevators are respectively arranged, the door knives and the car door locks shall be debugged in a cooperative manner, which is not only low in efficiency but also results in increase in failure rate.

As for the invention application with publication number as 101117870 and named as an elevator car door lock, the structure is as follows: a lock base frame is fixedly connected to a door motor base frame; a guide rod is arranged on the lock base frame; a sliding base and a compressed spring are arranged on the guide rod; a lock hook component is hinged on the sliding base; a collision block is arranged below the lock hook component; a subordinate lock hook is fixedly arranged on a door motor hanging plate; an unlocking blade is arranged on a landing door base plate in an unlocking region. The patent has the disadvantages that the door knife and the car door lock are respectively arranged and shall be mounted and debugged in a cooperative manner, which is not only low in efficiency but also results in increase in failure rate.

CONTENTS

In order to solve the technical problem of the prior art that the door knife and the car door lock are respectively arranged and shall be mounted and debugged in a cooperative manner, which is not only low in efficiency but also results in increase in failure rate, an asynchronous door knife of an elevator integrated car door lock, which is convenient to mount and debug and is better in safety performance, is provided.

The technical problem mentioned above is solved through the following technical scheme: an asynchronous door knife of an elevator integrated car door lock comprises a track rack on a car and a base plate on a car door; a dynamic blade and an unlocking blade which are parallel and connected on the bottom surface of the base plate in a swinging manner; a knife lifting ball which is matched with the track rack and is arranged on the dynamic blade; a lock hook driven by the unlocking blade is arranged on the back surface of the base plate, and the lock hook is correspondingly buckled with a latch on the car, wherein, the unlocking blade is connected on the base plate through a lifting plate; the lifting plate is hinged on the base plate and comprises a first swing arm and a second swing arm; the first swing arm is hinged with the unlocking blade; an unlocking connecting rod is connected on the second swing arm; a lifting hole is additionally formed on the base plate; the middle of the lock hook is hinged with the unlocking connecting rod through the lifting hole. According to the invention, the asynchronous door knife is arranged on the car door, so that the elevator car door lock is integrated with the asynchronous door knife, which makes is more convenient to mount and debug and enhances safety performance. The car door is unlocked through a way of lifting the lock hook, so that it is more practical to use and difficult to result in fault. When the unlocking blade displaces, the unlocking connecting rod is lifted through the lifting plate, so that the lock hook is lifted by the unlocking connecting rod and the lock hook is moved away from the latch.

As a preferred embodiment, there are two lifting plates which are vertically distributed; the lifting plates are of V-shaped structures; the first swing arm and the second swing arm are formed at two ends of each V-shaped structure; the tip end of the V-shaped structure of each lifting plate is hinged on the base plate; the first swing arms and the second swing arms are arranged upwards; the first swing arms of the two lifting plates are respectively hinged above and below the unlocking blade; the second swing arms of the two lifting plates are respectively hinged above and below the unlocking connecting rod; the unlocking connecting rod is parallel with the unlocking blade. Each lifting plate is arranged on the base plate in a V-shaped structure with two ends facing upwards and tip end facing downwards; a first hinge point is formed at the tip end of the V-shaped structure, and the V-shaped structure is hinged on the base plate through the first hinge point. According to the scheme, the two lifting plates are vertically distributed at intervals, and the first swing arms and the second swing arms are respectively hinged with the unlocking blade and the unlocking connecting rod, thus forming a four-bar linkage structure that the unlocking blade and the unlocking connecting rod are moved in a parallel manner.

As a preferred embodiment, the lock hook is of a V-shaped structure with one end formed with a lock catch part and the other end formed into a tail part; a catch head is arranged at the front end of the lock catch part; the catch head is matched and buckled with the latch; the tail part stretches out of the base plate and to the outer side of the unlocking blade; a first stop pin is additionally arranged on the unlocking connecting rod; the first stop pin runs through the lifting hole, and is located below the latch and a position deviating to the lock catch part. The lock catch can rotate around the hinge point; besides a function of unlocking through lifting, the lock catch further has a function of unlocking through rotating. The first stop pin is used for preventing the lock catch from rotating downwards. The lock catch part is under a horizontal state when the lock catch part of the lock catch is pressed on the first stop pin, and the catch head is buckled in the latch when the car door is locked.

As a preferred embodiment, the dynamic blade is connected on the base plate in a swinging manner through two connecting rods; one end of each connecting rod is hinged on the base plate and the other end faces to the inner side of the base plate and is hinged on the dynamic blade; a second stop pin is arranged on the base plate below the two connecting rods. The dynamic blade swings through the connecting rod; the second stop pin is used for stopping the unlocking blade from keeping dropping; the connecting rod swings downwards to press on the second stop pin, and the connecting rod is under a state of inclining downwards and facing the inner side of the base plate, so that the dynamic blade is lifted only when the knife lifting ball is matched and contacted with the track rack.

As a preferred embodiment, the track rack comprises two parts, i.e., a lifting track and a dropping rack; the lifting track and the dropping track are in transitional connection through an inclined track; the knife lifting ball is matched with the lifting track when the card door is closed. The knife lifting ball rolls on the track rack; the dynamic blade is lifted when the knife lifting ball enters into the part of the lifting track while the dynamic blade drops when the knife lifting ball enters into the part of the dropping track.

As a preferred embodiment, a pushing rod is arranged on the inner side face of the front end of the tail part of the lock hook; the pushing rod passes through the base plate and spans on the outer side of the dynamic blade; a manual pull rod is additionally connected on the front end of the tail part. On a path that the dynamic blade swings towards outer side, the pushing rod is contacted with the dynamic blade that swings towards outer side and the pushing rod is pushed to swing towards outer side, so that the lock hook rotates around the hinge point, and the lock catch is moved away from the latch when the lock catch part is lifted. Through the manual pull rod, the car door lock is manually opened, and the lock hook rotates around the hinge point and the lock catch part is lifted when the pull rod is manually pulled.

As a preferred embodiment, a compressed spring is arranged in the front of the lock catch part of the lock hook; the other end of the compressed spring is connected on a bracket; the bracket is fixed on the base plate. The lock catch part is buckled downwards by the compressed spring, so that the lock catch part is not easy to get loosed and not easy to move away from the latch.

As a preferred embodiment, the asynchronous door knife further comprises a switch pin and a switch socket; the switch pin is fixed on the lock hook; the switch socket is fixed on a landing door; the switch pin is matched and connected with the switch socket when the car levels off. The switch pin is matched and connected with the switch socket when the car levels off, so that the safety circuit is conducted, and both the door motor and the car door start working.

As a preferred embodiment, the catch head is a reverse hook; a cushioning inclined surface is formed on the outer side of the catch head reverse hook. Through the cushioning inclined surface, the catch head is buckled in the latch.

As a preferred embodiment, on the position close to the second swing arm, a third stop pin is arranged in a groove of the V-shaped structure of each lifting plate. The third stop pin can stop transition rotation of the lifting plate.

Therefore, the invention has the advantages that: by setting the asynchronous door knife on the car door, the elevator car door lock is integrated with the asynchronous door knife, thus it is more convenient to mount and debug and the safety performance is better. The car door is unlocked through a way of lifting the lock hook, so that it is more practical to use and difficult to result in fault.

1: base plate; 2: dynamic blade; 3: unlocking blade; 4: lock hook; 5: latch; 6: unlocking connecting rod; 7: lifting plate; 8: connecting plate; 9: knife lifting ball; 10: track rack; 11: lifting track; 12: dropping track; 13: the first swing arm; 14: the second swing arm; 15: the third stop pin; 16: the second stop pin; 17: manual pull rod; 18: lock catch part; 19: tail part; 20: the first stop pin; 21: catch head; 22: cushioning inclined surface; 23: pushing rod; 24: compressed spring; 25: bracket; 26: switch pin; 27: switch socket; 28: lifting hole

DESCRIPTION OF THE EMBODIMENTS

The technical solutions of the embodiment will be described in details in connection with the drawings.

Embodiment

Figure 1:
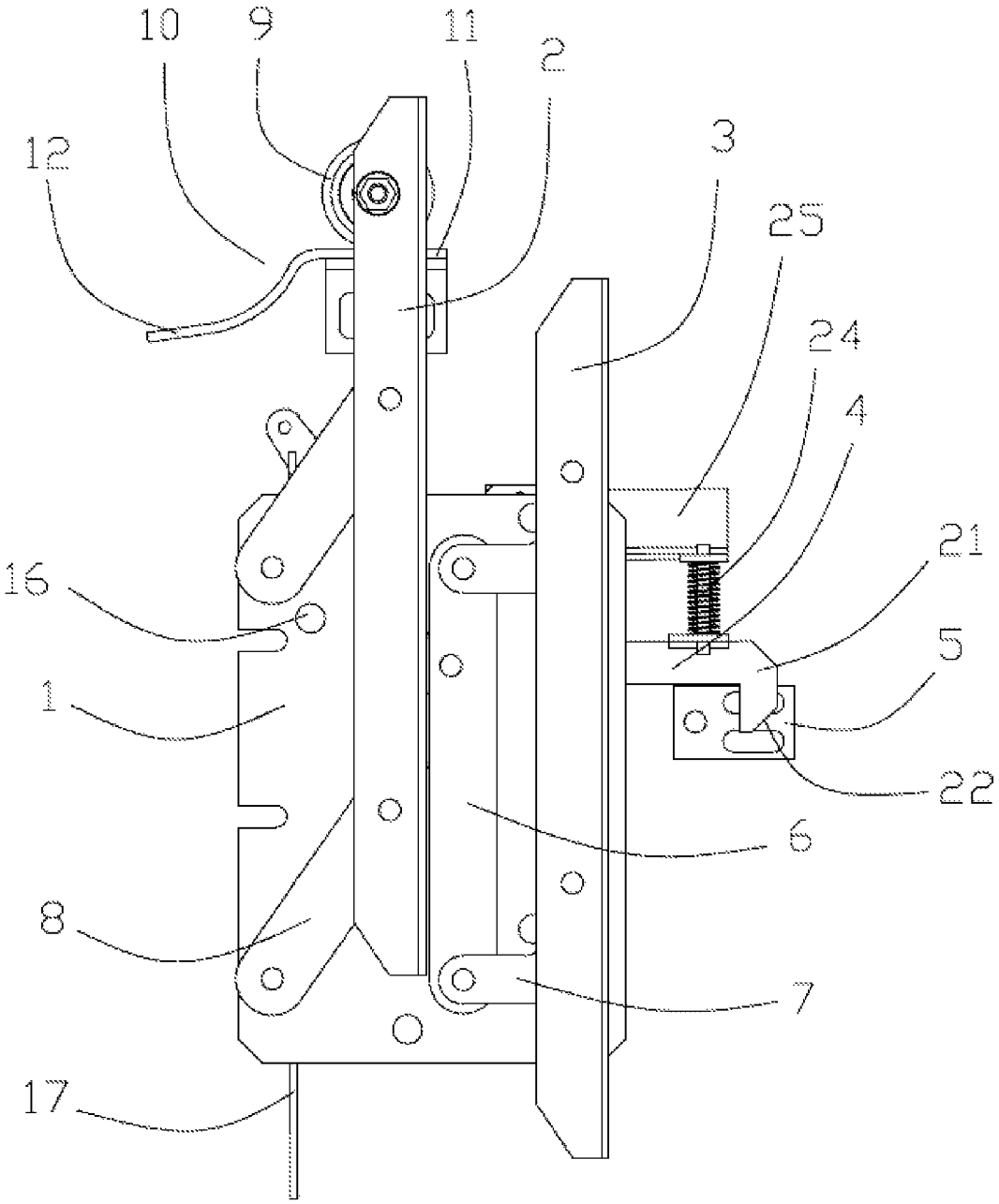
FIG. 1 is a structural schematic diagram of front face of the present invention.
Figure 2:
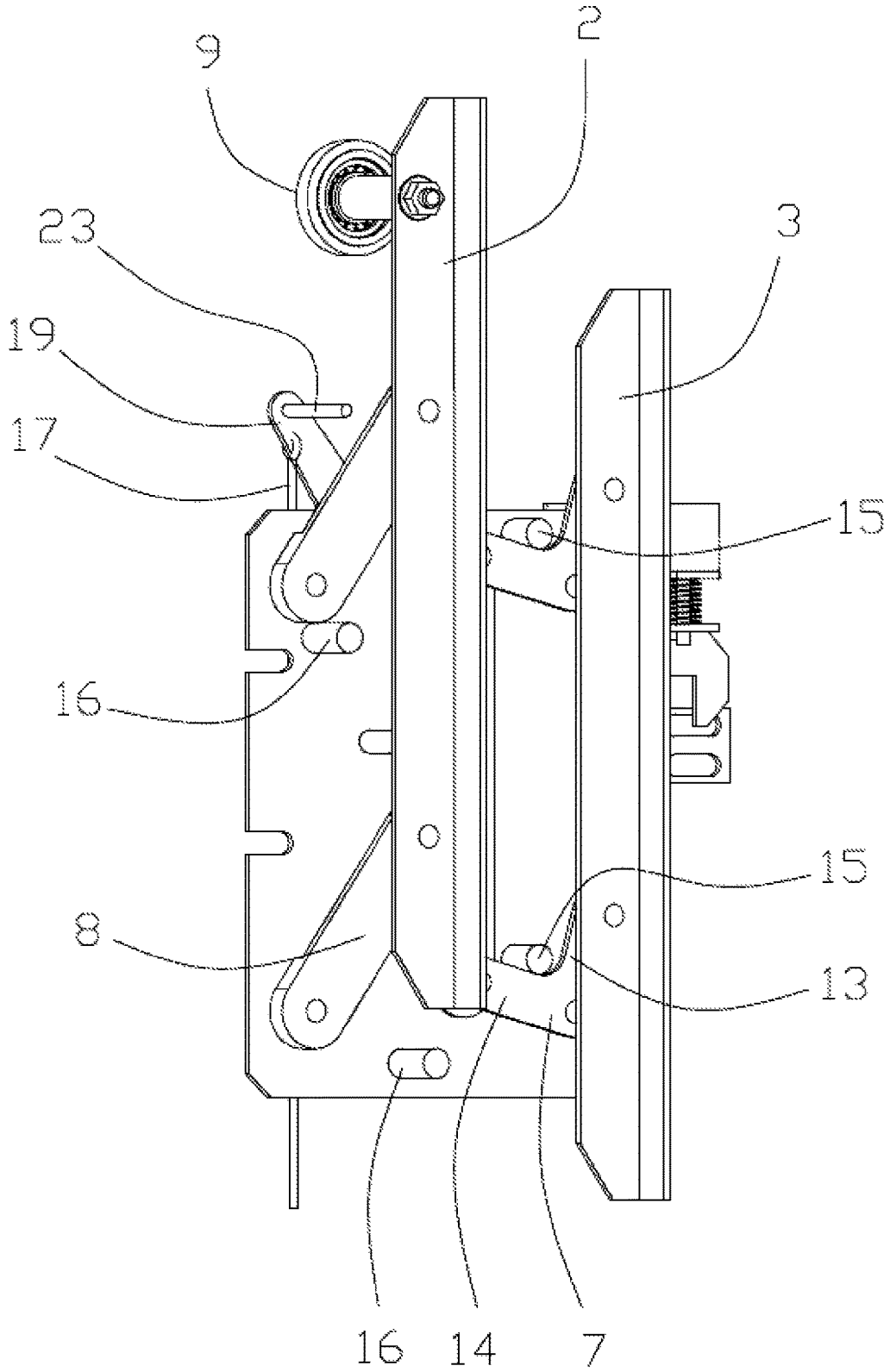
FIG. 2 is a structural schematic diagram of front face of the present invention from another view.

According to an embodiment of the present invention, there is provided an asynchronous door knife of an elevator integrated car door lock, which as shown in FIG. 1 and FIG. 2, comprises a base plate 1, a track rack 10, a latch 5 and an unlocking mechanism on the base plate, wherein the base plate is arranged on the car door; the track rack is arranged on a position of the car relative to the upper part of car door and the latch is arranged on a position of the car relative to one side of the car door. The unlocking mechanism comprises a dynamic blade 2, an unlocking blade 3, an unlocking connecting rod 6 and a lock hook 4.

The dynamic blade 2 and the unlocking blade 3 are connected on the front face of the base plate in a swinging manner; the dynamic blade, the unlocking blade and the unlocking connecting rod are mutually parallel; the dynamic blade is arranged on the left side, i.e., the side away from the latch, and is connected to the base plate through two connecting rods 8; the connecting rods are vertically distributed; one end of each connecting rod is hinged on the base plate and the other end is hinged on the dynamic blade in a manner of facing the inner side of the base plate, and a second stop pin 16 is arranged on the base plate below the two connecting rods. The unlocking blade is connected on the base plate in a swinging manner through the lifting plate 7; the two lifting plates are vertically distributed; the lifting plates are of V-shaped structures; the first swing arm 13 and the second swing arm 14 are formed at two ends of each V-shaped structure; the tip end of the V-shaped structure of each lifting plate is hinged on the base plate; the first swing arms and the second swing arms are arranged upwards; the first swing arms of the two lifting plates are respectively hinged above and below the unlocking blade; the second swing arms of the two lifting plates are respectively hinged above and below the unlocking connecting rod, thus forming a four-bar linkage structure that the unlocking blade and the unlocking connecting rod are moved in a parallel manner. On a position close to the second swing arm, a third stop pin 15 is arranged in the groove of the V-shaped structure of each lifting plate.

Figure 3:
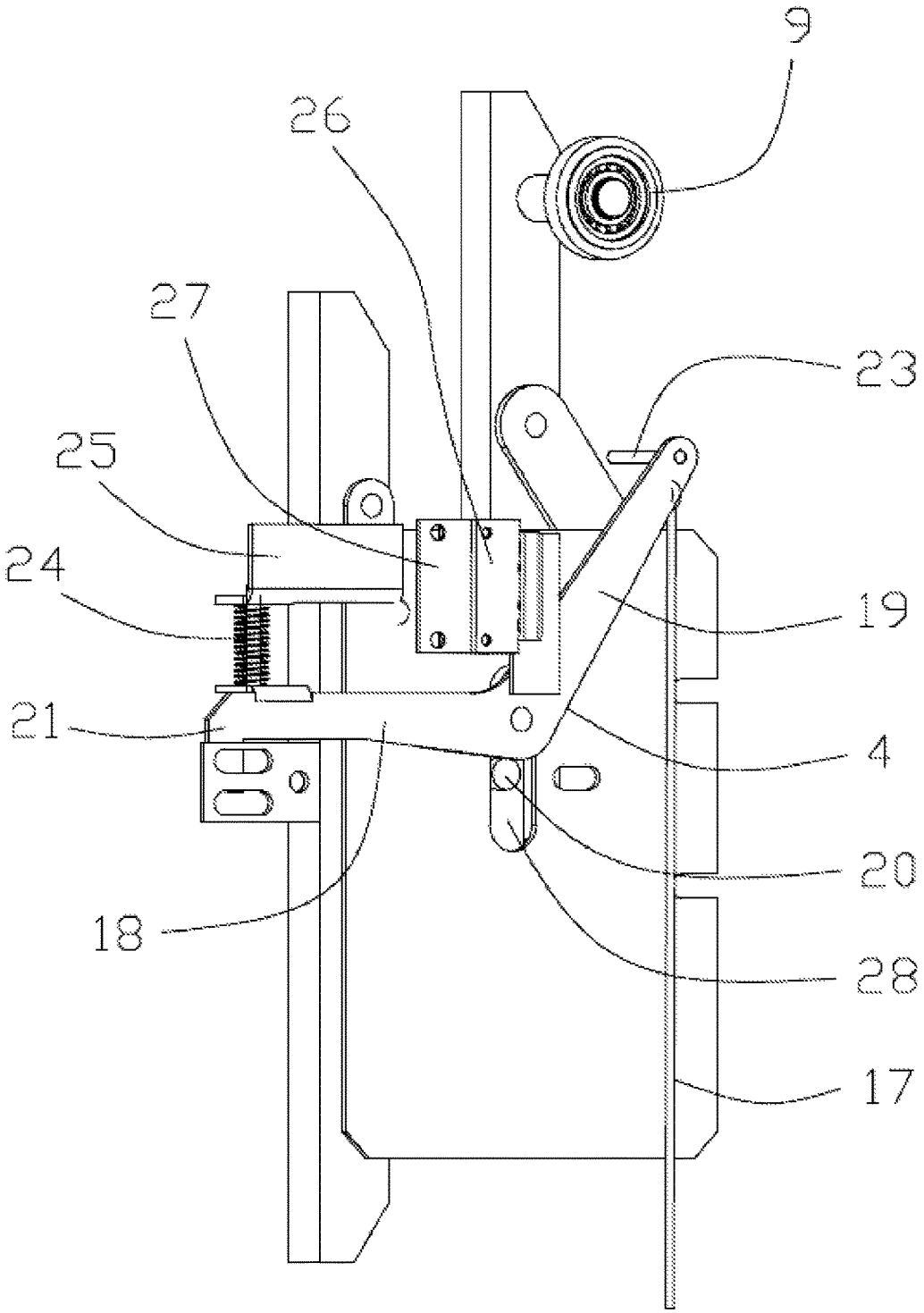
FIG. 3 is a structural schematic diagram of back face of the present invention.

As shown in FIG. 3, a rectangular lifting hole 28 is formed on the base plate corresponding to the position of the unlocking connecting rod; the lock hook is arranged on the back surface of the base plate, and the lock hook is hinged with the unlocking connecting rod on the other surface through the lifting hole. The lock hook is of a V-shaped structure with one end formed with a lock catch part 18 and the other end formed into a tail part 19; a catch head 21 is arranged at the front end of the lock catch part; the catch head is a reverse hook which is provided with a cushioning inclined surface 22 on the outer side; the catch head is matched and buckled with the latch 5 when the car door is closed while the tail part stretches out of the base plate and to the outer side of the unlocking blade; a first stop pin 20 is further arranged on the unlocking connecting rod; the first stop pin runs through the lifting hole, and is located below the latch and a position deviating to the lock catch part. A compressed spring 24 is arranged in the front of the lock catch part of the lock hook; the other end of the compressed spring is connected on a bracket 25, and the bracket is fixed on the base plate.

As shown in FIG. 1, the track rack comprises two parts, i.e., a lifting track 11 and a dropping track 12, and the lifting track and the dropping track are in transition connection through an inclined track; a knife lifting ball 9 matched with the track rack is arranged at the upper end of the dynamic blade, and the knife lifting ball rolls and works on the track rack.

A pushing rod 23 is arranged on the inner side face of the front end of the tail part of the lock hook; the pushing rod passes through the base plate and spans on the outer side of the dynamic blade 2; a manual pull rod 17 is additionally connected on the front end of the tail part.

According to the embodiment, the door knife device further comprises a switch pin 26 and a switch socket 27; the switch pin is fixed on the lock hook; the switch socket is fixed on a landing door; the switch pin is matched and connected with the switch socket when the car levels off.

When the car door and the landing door are on a same height and the car door and the landing door are normally opened, a landing door ball is located between the dynamic blade and the unlocking blade; driven by the door motor, the car door is opened, the base plate mounted on the car door is moved along with the car door, and the unlocking blade on the base plate swings under blockage function of the landing door ball; the two lifting plates are synchronously triggered and rotated by the unlocking blade and get into contact with the third stop pin; the unlocking connecting rod is driven to swing through the second swing arms of the two lifting plates, the unlocking connecting rod moves upwards, the lock hook moves along the unlocking connecting rod and is lifted, the catch head moves away from the latch and escapes from a clamping state with the latch; the car door continuously moves under the driving of the door motor; meanwhile, the knife lifting ball on the dynamic blade swings under guiding function of the track rack and drops onto the dropping track from the lifting track; the dynamic blade swings downwards; the landing door ball is clamped by both the dynamic blade and the unlocking blade, so as to open the landing door.

When the car door and the landing door are on a same height and the car door and the landing door are normally closed, under driving of the door motor, the car door moves, at which time, the dynamic blade is still under a state of swinging downwards under gravity; the landing door ball is clamped by both the dynamic blade and the unlocking blade, so as to move the landing door; when the base plate along with the car door, the unlocking blade is moved to keep lifted state of the lock hook under blockage action of the landing door ball, and the landing door ball moves until the landing door is closed, at which time, the knife lifting ball enters onto the lifting track under guidance of the track rack, the dynamic blades swings and is lifted upwards, the landing door ball gradually moves away from the unlocking blade; holding force of the unlocking blade losses; the two lifting plates rotate synchronously; the second swing arms swing downwards, so that the unlocking connecting rod moves downward and the lock hook is clamped with the latch under self-gravity and function of the compressed spring, thus closing the car door.

When the car door and the landing door are on a same height and the landing door is to be opened outside the car, the dynamic blade is moved by the landing door ball; edge of the dynamic blade gets into contact with the pushing rod at the tail of the unlocking latch; the lock hook rotates to release a clamping state with the latch, thus opening the car door and the landing door.

When the car door and the landing door are not on a same height and the car door and the landing door are to be opened, the car door is manually moved by a certain distance and the manual pull rod is pulled, so that the lock hook is lifted to release a clamping state between the lock hook and the latch, thus opening the car door and the landing door.

The foregoing embodiments merely are exemplary embodiments of the invention. Technicians of the technical field of the invention can modify or compensate the described specific embodiments or replace through similar ways, without deviating from the spirit of the invention or exceeding the scope of the invention defined by the appended claims.

Although this specification adopts such terms as base plate, dynamic blade, unlocking blade, lock hook and latch frequently, it does not exclude possibility of other terms. Those terms are just for convenient description and interpretation of the essence of the invention; any interpretation of the terms into additional limitation deviates from the spirit of the invention.

The invention claimed is:

1. An asynchronous door knife of an elevator integrated car door lock, which comprises a track rack on a car and a base plate on a car door; a dynamic blade and an unlocking blade which are parallel and connected on the bottom surface of the base plate in a swinging manner; a knife lifting ball which is matched with the track rack and is arranged on the dynamic blade; a lock hook driven by the unlocking blade is arranged on the back surface of the base plate, and the lock hook is correspondingly buckled with a latch on the car, wherein the unlocking blade is connected on the base plate through a lifting plate; the lifting plate is hinged on the base plate and comprises a first swing arm and a second swing arm; the first swing arm is hinged with the unlocking blade; an unlocking connecting rod is connected on the second swing arm, the unlocking blade and the unlocking connecting rod are moved in a parallel manner; a lifting hole is additionally formed on the base plate; the middle of the lock hook is hinged with the unlocking connecting rod through the lifting hole.

2. The asynchronous door knife of the elevator integrated car door lock according to claim 1, wherein the lock hook is of a V-shaped structure with one end formed into a lock catch part and the other end formed into a tail part; a catch head is arranged at the front end of the lock catch part; the catch head is matched and buckled with the latch; the tail part stretches out of the base plate and to the outer side of the unlocking blade; a first stop pin is additionally arranged on the unlocking connecting rod; the first stop pin runs through the lifting hole, and is located below the latch and a position deviating to the lock catch part.

3. The asynchronous door knife of the elevator integrated car door lock according to claim 2, wherein the catch head is a reverse hook; a cushioning inclined surface is formed on the outer side of the catch head reverse hook.

4. The asynchronous door knife of the elevator integrated car door lock according to claim 1, wherein the dynamic blade is connected on the base plate in a swinging manner through two connecting rods; one end of each connecting rod is hinged on the base plate and the other end faces to the inner side of the base plate and is hinged on the dynamic blade; a second stop pin is arranged on the base plate below the two connecting rods.

5. The asynchronous door knife of the elevator integrated car door lock according to claim 1, wherein the track rack comprises a lifting track and a dropping rack; the lifting track and the dropping track are in transitional connection through an inclined track; the knife lifting ball is matched with the lifting track when the card door is closed.

6. The asynchronous door knife of the elevator integrated car door lock according to claim 1, further comprising a switch pin and a switch socket; the switch pin is fixed on the lock hook; the switch socket is fixed on a landing door; the switch pin is matched and connected with the switch socket when the car levels off.

7. An asynchronous door knife of an elevator integrated car door lock, which comprises a track rack on a car and a base plate on a car door; a dynamic blade and an unlocking blade which are parallel and connected on the bottom surface of the base plate in a swinging manner; a knife lifting ball which is matched with the track rack and is arranged on the dynamic blade; a lock hook driven by the unlocking blade is arranged on the back surface of the base plate, and the lock hook is correspondingly buckled with a latch on the car, wherein the unlocking blade is connected on the base plate through a lifting plate; the lifting plate is hinged on the base plate and comprises a first swing arm and a second swing arm; the first swing arm is hinged with the unlocking blade; an unlocking connecting rod is connected on the second swing arm; a lifting hole is additionally formed on the base plate; the middle of the lock hook is hinged with the unlocking connecting rod through the lifting hole;

wherein there are two lifting plates which are vertically distributed; the lifting plates are of V-shaped structures; the first swing arm and the second swing arm are formed at two ends of each V-shaped structure; the tip end of the V-shaped structure of each lifting plate is hinged on the base plate; the first swing arms and the second swing arms are arranged upwards; the first swing arms of the two lifting plates are respectively hinged above and below the unlocking blade; the second swing arms of the two lifting plates are respectively hinged above and below the unlocking connecting rod; the unlocking connecting rod is parallel with the unlocking blade.

8. The asynchronous door knife of the elevator integrated car door lock according to claim 7, wherein on the position close to the second swing arm, a third stop pin is arranged in a groove of the V-shaped structure of the lifting plate.

9. An asynchronous door knife of an elevator integrated car door lock, which comprises a track rack on a car and a base plate on a car door; a dynamic blade and an unlocking blade which are parallel and connected on the bottom surface of the base plate in a swinging manner; a knife lifting ball which is matched with the track rack and is arranged on the dynamic blade; a lock hook driven by the unlocking blade is arranged on the back surface of the base plate, and the lock hook is correspondingly buckled with a latch on the car, wherein the unlocking blade is connected on the base plate through a lifting plate; the lifting plate is hinged on the base plate and comprises a first swing arm and a second swing arm; the first swing arm is hinged with the unlocking blade; an unlocking connecting rod is connected on the second swing arm; a lifting hole is additionally formed on the base plate; the middle of the lock hook is hinged with the unlocking connecting rod through the lifting hole;

wherein the lock hook is of a V-shaped structure with one end formed into a lock catch part and the other end formed into a tail part; a catch head is arranged at the front end of the lock catch part; the catch head is matched and buckled with the latch; the tail part stretches out of the base plate and to the outer side of the unlocking blade; a first stop pin is additionally arranged on the unlocking connecting rod; the first stop pin runs through the lifting hole, and is located below the latch and a position deviating to the lock catch part;

wherein a pushing rod is arranged on the inner side face of the front end of the tail part of the lock hook; the pushing rod passes through the base plate and spans on the outer side of the dynamic blade; a manual pull rod is additionally connected on the front end of the tail part.

10. An asynchronous door knife of an elevator integrated car door lock, which comprises a track rack on a car and a base plate on a car door; a dynamic blade and an unlocking blade which are parallel and connected on the bottom surface of the base plate in a swinging manner; a knife lifting ball which is matched with the track rack and is arranged on the dynamic blade; a lock hook driven by the unlocking blade is arranged on the back surface of the base plate, and the lock hook is correspondingly buckled with a latch on the car, wherein the unlocking blade is connected on the base plate through a lifting plate; the lifting plate is hinged on the base plate and comprises a first swing arm and a second swing arm; the first swing arm is hinged with the unlocking blade; an unlocking connecting rod is connected on the second swing arm; a lifting hole is additionally formed on the base plate; the middle of the lock hook is hinged with the unlocking connecting rod through the lifting hole;

wherein a compressed spring is arranged in the front of the lock catch part of the lock hook; the other end of the compressed spring is connected on a bracket; the bracket is fixed on the base plate.

* * * * *